US009841030B2

(12) United States Patent
Xiang et al.

(10) Patent No.: US 9,841,030 B2
(45) Date of Patent: Dec. 12, 2017

(54) VERTICAL SELF-PRIMING PUMP

(71) Applicants: Guanghui Xiang, Zhejiang (CN); Xiangxun Jiang, Zhejiang (CN); Huaiyu Chen, Jiangsu (CN)

(72) Inventors: Guanghui Xiang, Zhejiang (CN); Xiangxun Jiang, Zhejiang (CN); Huaiyu Chen, Jiangsu (CN)

( * ) Notice: Subject to any disclaimer, the term of this patent is extended or adjusted under 35 U.S.C. 154(b) by 0 days.

(21) Appl. No.: 15/245,370

(22) Filed: Aug. 24, 2016

(65) Prior Publication Data

US 2016/0363124 A1 Dec. 15, 2016

Related U.S. Application Data

(63) Continuation of application No. 13/812,529, filed as application No. PCT/CN2011/070749 on Jan. 28, 2011, now abandoned.

(30) Foreign Application Priority Data

Jul. 28, 2010 (CN) ..... 2010 1 0238241

(51) Int. Cl.

| | |
|---|---|
| ***F04D 9/02*** | (2006.01) |
| ***F04D 29/02*** | (2006.01) |
| ***F04D 29/16*** | (2006.01) |
| ***F04D 29/22*** | (2006.01) |

(52) U.S. Cl.

CPC ..... *F04D 29/026* (2013.01); *F04D 29/167* (2013.01); *F04D 29/2266* (2013.01); *F05B 2240/30* (2013.01); *F05B 2280/2006* (2013.01); *F05B 2280/20071* (2013.01); *F05B 2280/4005* (2013.01)

(58) Field of Classification Search

CPC ... F04D 9/02; F04D 9/008; F04D 9/00; F04D 9/001; F04D 9/002; F04D 9/003; F04D 29/026; F04D 29/2266; F04D 29/167; F05B 2240/30; F05B 2280/20071; F05B 2280/4005; F05B 2280/2006

See application file for complete search history.

*Primary Examiner* — Peter J Bertheaud
*Assistant Examiner* — Dnyanesh Kasture
(74) *Attorney, Agent, or Firm* — Kile Park Reed & Houtteman LLC

(57) ABSTRACT

The present invention claims a vertical self-priming pump which comprises a pump body, a motor and a medium backflow blocking device, the medium backflow blocking device comprises a static ring and a moving ring which are vertically and oppositely arranged, and an elastic supporting sleeve; the moving ring is embedded on the upper surface of the impeller, the elastic supporting sleeve is fixed on the upper surface of the flow guide body, and the static ring is embedded on the lower surface of an elastic supporting ring. During normal working, the elastic supporting sleeve of the present invention in the medium backflow blocking device generates a downward deformation under the action of liquid medium pressure, thus the moving ring and the static ring closely contact with each other and block the backflow gap channel, and the pump efficiency is improved.

9 Claims, 4 Drawing Sheets

VERTICAL SELF-PRIMING PUMP

TECHNICAL FIELD

The present invention relates to pump, specifically to a vertical self-priming pump.

BACKGROUND ART

The self-priming pump is capable of starting to work at the situation that the liquid inlet pipe is not filled with liquid medium (but the must be enough liquid medium in the pump body) and automatically exhausting gas in the liquid inlet pipe. When the pump is started for the first time, there must be enough liquid medium added into the pump body of the self-priming pump; after this, the self-priming pump can start again by the liquid medium remaining in the pump body. The self-priming pump can be divided into two types according to working principle, including internal mixing type and external mixing type. The internal mixing type self-priming pump means that the gas-liquid mixing is carried out near the inlet of the impeller, while the external mixing type self-priming pump means that the gas-liquid mixing is carried out at the outer edge of the impeller. Structure of the external mixing type self-priming pump is as shown in FIG. 1. Before the initial startup, the pump cavity is filled with water at first; after startup, the impeller 1 rotates at a high speed to eliminate liquid medium in the impeller flow channel 2, so as to form negative pressure at the liquid inlet opening of the impeller 1 to suck gas in the liquid inlet pipe 4 into the pump cavity and form gas-liquid mixture with the liquid medium in the pump cavity; and the gas-liquid mixture is discharged to the gas-liquid separation chamber on top of the pump cavity through the impeller flow channel 2 on the impeller; because the exit area of the impeller flow channel 2 becomes big suddenly, the flow velocity decreases suddenly, so the gas separates from the liquid and is discharged from the water outlet pipe 5 on the pump body; and the liquid medium sinks and flows back to the outer edge of the impeller 1 through the backflow gap 3 because it is heavy, and it continues to mix with gas sucked in from the impeller flow channel 2; all gas in the liquid inlet pipe 4 can be gradually discharged after repeated circulation to make the liquid medium enter into the pump cavity and finish the self-priming process.

However, because there is a backflow gap 3 in the self-priming pump structure, the remaining medium keeps circulating under action of the pressure, which causes big loss in volume efficiency. The test shows that the loss is about 8%, which lowers down the efficiency of the self-priming pump seriously. Besides, the self-priming pump cannot reach the normal flow and pump head, and energy consumption is increased.

SUMMARY OF THE INVENTION

The present invention aims to solve the technical problem that the self-priming pump is low in efficiency.

In order to solve the above problem, the present invention provides a vertical self-priming pump that comprises a pump body, a motor and a medium backflow blocking device.

The inner cavity of the pump body is divided into a gas-liquid separation chamber and a liquid storage chamber through a middle partition plate that is provided with an axial inlet opening, and the gas-liquid separation chamber is above the liquid storage chamber; a flow guide body is fixed on the upper surface of the middle partition plate; the flow guide body is provided with an axial through hole and a radial flow guide hole that is in communication with the axial through hole, and the gas-liquid separation chamber is in communication with the liquid storage chamber through the axial inlet opening and the radial flow guide hole on the flow guide body; a motor, which is fixed on the top of the pump body for driving a pump shaft that vertically downward penetrates into the inner cavity of the pump body to rotate, and an impeller that is arranged in the axial through hole of the flow guide body is fixed on the lower end of the pump shaft; a backflow gap channel is formed between the outer circumferential surface of the impeller and the inner wall of the axial through hole of the flow guide body; further comprising a medium backflow blocking device that comprises a static ring and a moving ring which are vertically and oppositely arranged as well as an elastic supporting sleeve; the moving ring is embedded on the upper surface of the impeller, and the outer edge of the elastic supporting sleeve extends downwards to form a supporter that is fixed on the upper surface of the flow guide body; the static ring is embedded on the lower surface of an elastic supporting ring, and the lower end surface of the static ring protrudes the lower surface of the elastic supporting sleeve, and a gap is formed between the lower end surface of the static ring and the upper end of the moving ring.

In the above proposal, the self-priming pump further comprises a flow-blocking depressurization plate; upper part of the impeller is in a step-like axle shape with top part smaller than lower part, and the flow-blocking depressurization plate is in a step-like sleeve shape with top part bigger than the lower part and provided with an axle hole; the flow-blocking depressurization plate is vertically sleeved on the impeller with the big-diameter part fixed on the flow guide body; a backflow gap channel is formed by the gap between inner wall of the axle hole of the flow-blocking depressurization plate and outer circumferential surface of the small-diameter part of the impeller and the gap between the lower end surface of the flow-blocking depressurization plate and step surface of the impeller.

In the above proposal, the size of the backflow gap channel is 0.3-0.5 mm.

In the above proposal, the gap channel between the lower end surface of the flow-blocking depressurization plate and step surface of the impeller is provided with a downwards slant dip angle.

In the above proposal, the dip angle is 3-8 degrees.

In the above proposal, the inner wall of axle hole of the flow-blocking depressurization plate is provided with a plurality of circular grooves.

In the above proposal, the moving ring and the static ring are separately made of hard alloy, silicon carbide, ceramic, graphite or polytetrafluoroethylene.

In the present invention, a medium backflow blocking device is provided on the upper surface of the impeller. During normal working, the elastic supporting sleeve of the present invention in the medium backflow blocking device generates a downward deformation under the action of liquid medium pressure, thus the moving ring and the static ring closely contact with each other and block the backflow gap channel, therefore the volume loss generated by the backflow is avoided, and the pump efficiency can be improved by 5%-8%.

DETAILED DESCRIPTION OF THE PREFERRED EMBODIMENTS

The vertical self-priming pump provided in the present invention improves the working efficiency through the medium backflow blocking device. During the startup and vacuumizing process of the self-priming pump, the medium backflow blocking device does not take effect; when the vacuum izing process is finished and the self-priming pump works normally, because the pressure in the gas-liquid separation chamber is enlarged, the backflow gap channel is blocked through the medium backflow blocking device, so as to reduce the backflow loss of the self-priming pump and improve the working efficiency. The following is detailed description to the present invention combining drawings and embodiments.

Figure 1:
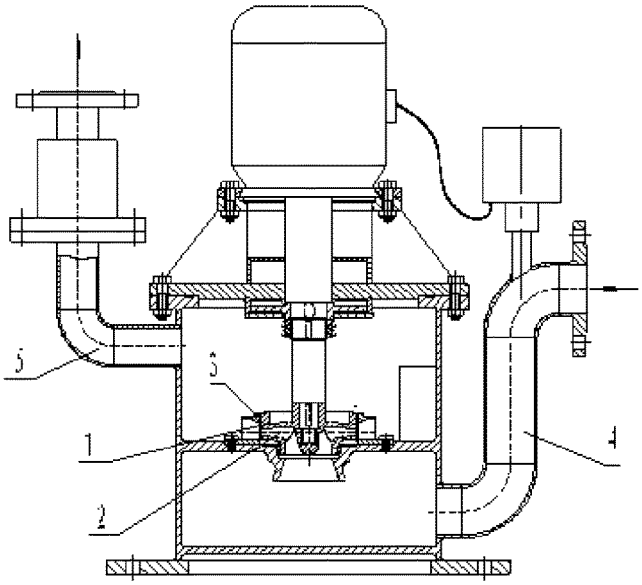
FIG. 1 is the structure diagram of the existing vertical self-priming pump.
Figure 2:
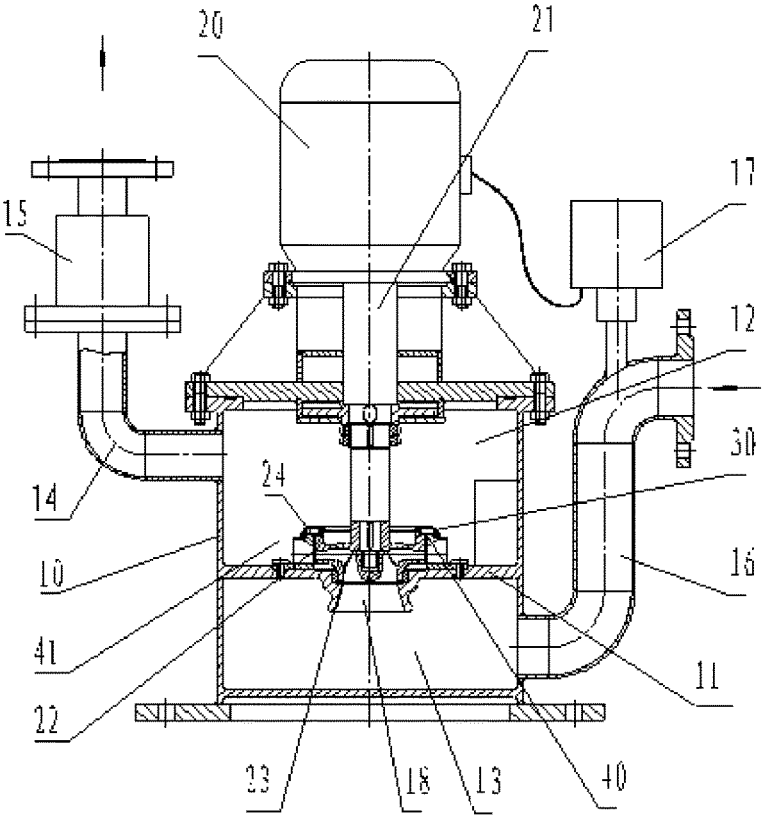
FIG. 2 is the structure diagram of the first specific implementation method of the vertical self-priming pump provided in the present invention.

FIG. 2 is the structure diagram of the first specific implementation method of the vertical self-priming pump provided in the present invention. As shown in FIG. 2, the vertical self-priming pump provided in the present invention comprises a pump body 10, a motor 20 and a medium backflow blocking device 30.

The pump body 10 comprises an inner cavity that is vertically divided into a gas-liquid separation chamber 12 and a liquid storage chamber 13 through a middle partition plate 11; a liquid inlet pipe 14 is arranged on the gas-liquid separation chamber 12, and the liquid outlet pipe 14 is provided with check valve 15; the liquid storage chamber 13 is provided with a liquid inlet pipe 16 that is provided with a vacuum breaking valve 17.

The middle partition plate 11 is provided with an axial inlet opening, and a flow guide body 40 is fixed on the upper surface of the middle partition plate 11; the flow guide body 40 is provided with an axial through hole and a radial flow guide hole 41 that is in communication with the axial through hole, the medium backflow blocking device 30 is provided on the upper surface of the flow guide body 40; the gas-liquid separation chamber 12 is in communication with the liquid storage chamber 13 through the axial inlet opening 18 and the radial flow guide hole 41 on the flow guide body 40.

A motor 20 is fixed on the top of the pump body 10 for driving a pump shaft 21 that vertically downward penetrates into the inner cavity of the pump body 10 to rotate, and an impeller 22 that is arranged in the axial through hole of the flow guide body 40 is fixed on the lower end of the pump shaft 21; an impeller channel 23 is provided inside the impeller 22, and inlet of the impeller channel 23 is in communication with the liquid storage chamber 13 through the axial inlet hole 18, and the outlet of the impeller channel 23 is in communication with the gas-liquid separation chamber 12 through the radial flow guide hole 41 on the flow guide body 40; a backflow gap channel 24 is formed between the outer circumferential surface of the impeller 22 and the inner wall of the axial through hole of the flow guide body 40; the size of the backflow gap channel 24 is 0.3-0.5 mm.

Figure 4:
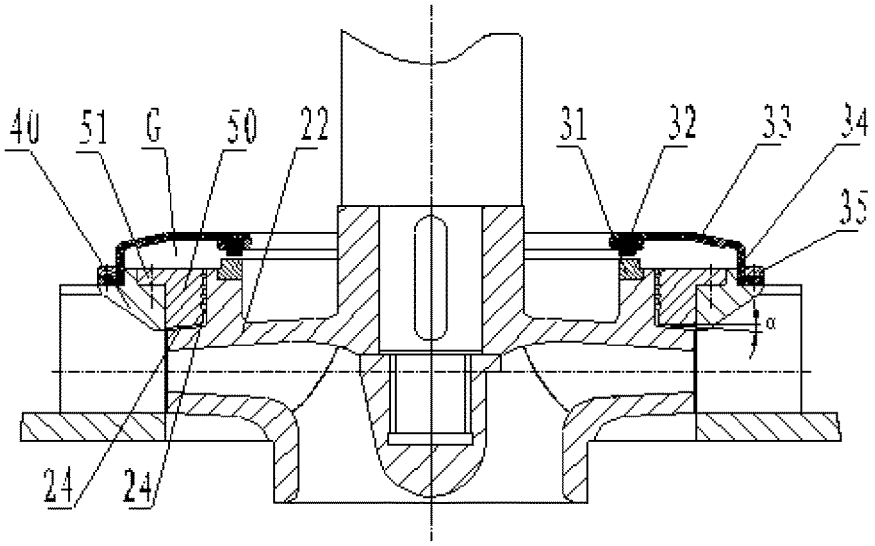
FIG. 4 is the installation diagram of the medium backflow blocking device of the vertical self-priming pump provided in the present invention.

As shown in FIG. 4, the medium backflow blocking device 30 comprises a static ring 32 and a moving ring 31 which are vertically and oppositely arranged as well as an elastic supporting sleeve 33; the moving ring 31 is embedded on the upper surface of the impeller 22, and the upper surface of the moving ring 31 is higher than that of the impeller 22; the elastic supporting sleeve 33 comprises a round main body with outer edge extending downwards to form a supporter 34 that is provided with a flange at the lower end, and the flange is fixed on the upper surface of the flow guide body 40 through a pressing block 35; the static ring 32 is embedded on the lower surface of main body of the elastic supporting sleeve 33, and the lower end surface of the static ring 32 protrudes the lower surface of main body of the elastic supporting sleeve 33. The end surfaces of the moving ring 31 and the static ring 32 that are opposite to each other are processed by mirror grinding and provided with gap, and the material thereof can be hard alloy, silicon carbide, ceramic, graphite or F4 (polytetrafluoroethylene) for different mediums.

Figure 3:
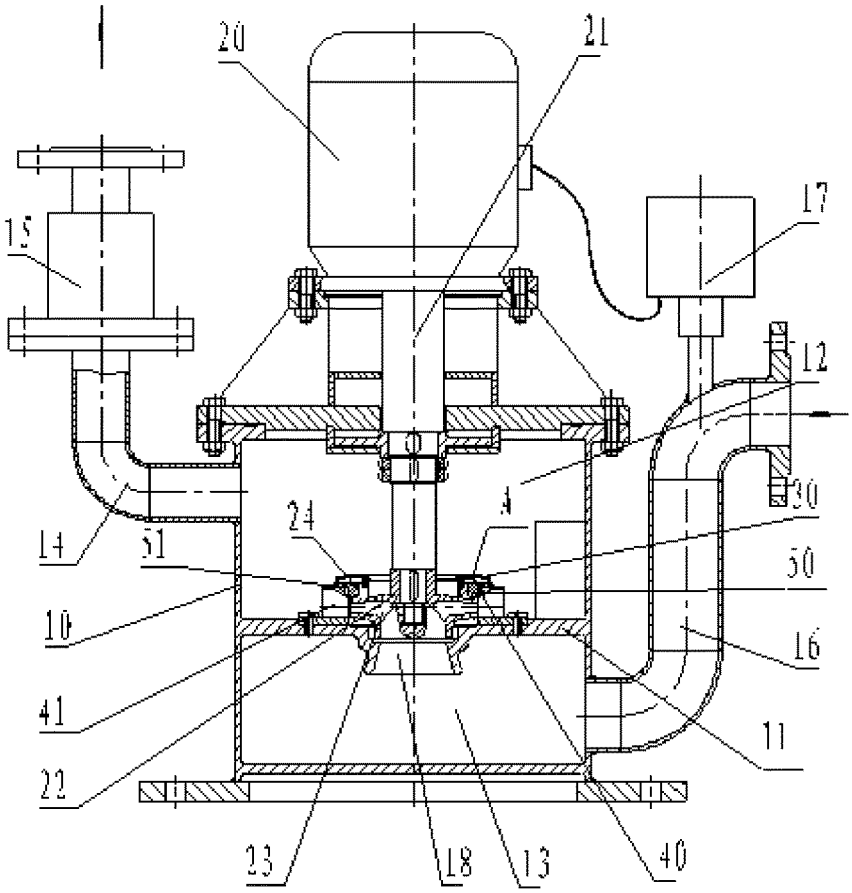
FIG. 3 is the structure diagram of the second specific implementation method of the vertical self-priming pump provided in the present invention.

It is well known that the impeller of the vertical self-priming pump is easy to be worn. The outer circumferential surface of the impeller is easy to be worn in use; in order to reduce cost of replacing the impeller; the present invention improves the structure of impeller. The specific improvement is as shown in FIG. 3 that is the structure diagram of the second specific implementation method of the vertical self-priming pump provided in the present invention; and FIG. 4 is the installation diagram of the medium backflow blocking device. As shown in FIG. 3 and FIG. 4, the difference of this embodiment from the first embodiment is that a flow-blocking depressurization plate 50 is arranged on the impeller 22, and the respective structure of impeller 22 is also changed accordingly as follows: upper part of the impeller 22 is in a step-like axle shape with top part smaller than lower part, and the flow-blocking depressurization plate 50 is in a step-like sleeve shape with top part bigger than the lower part and provided with an axle hole; the flow-blocking depressurization plate 50 is vertically sleeved on the impeller 22 with the big-diameter part fixed on the flow guide body 40; a backflow gap channel 24 is formed by the gap between inner wall of the axle hole of the flow-blocking depressurization plate 50 and outer circumferential surface of the small-diameter part of the impeller 22 and the gap between the lower end surface of the flow-blocking depressurization plate 50 and step surface of the impeller 22. Besides, the gap channel between the lower end surface of the flow-blocking depressurization plate 50 and step surface of the impeller 22 is provided with a downwards slant dip angle $\alpha$ which is 3-8 degrees.

Figure 5:
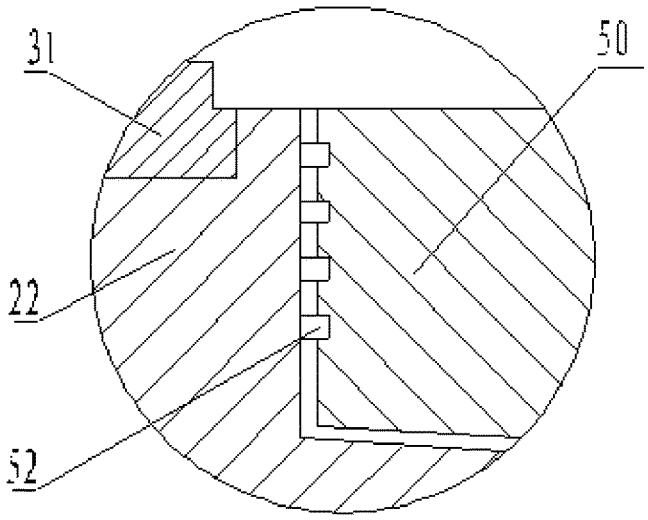
FIG. 5 is the enlarged drawing of part A in FIG. 3.

Further, the inner wall of axle hole of the flow-blocking depressurization plate 50 is provided with a plurality of circular grooves 52 (as shown in FIG. 5) to function as diffusion and depressurization.

Figure 6:
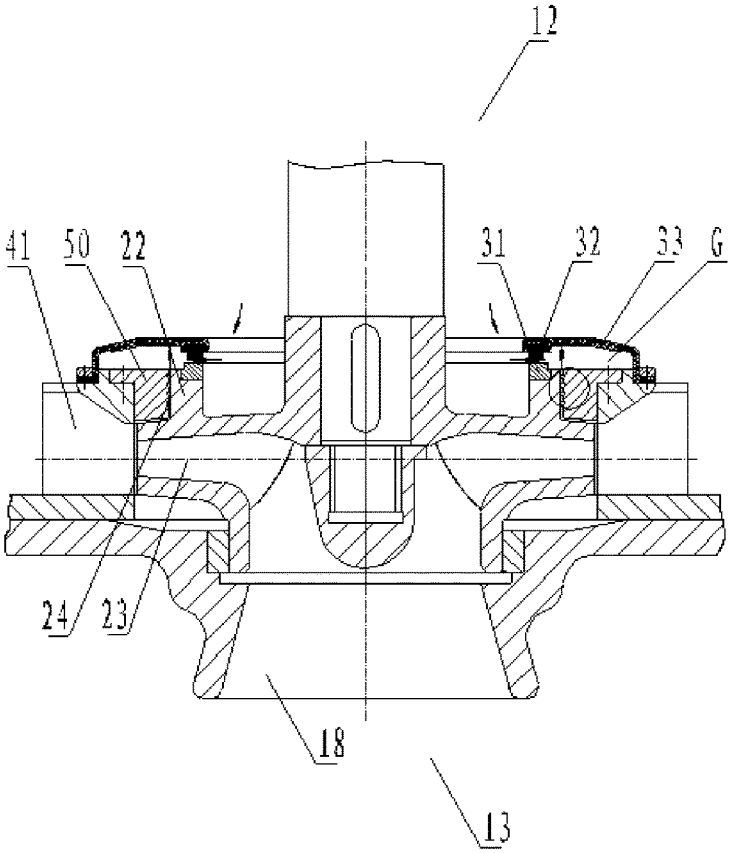
FIG. 6 is the schematic diagram of medium backflow of the second vertical self-priming pump provided in the present invention in startup status.
Figure 7:
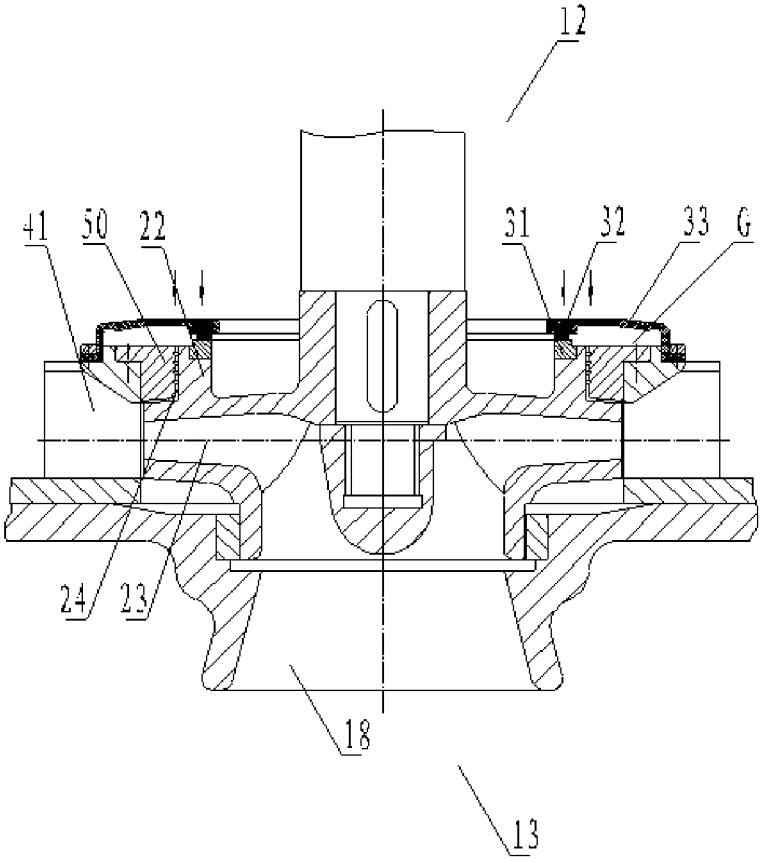
FIG. 7 is the schematic diagram of medium backflow of the second vertical self-priming pump provided in the present invention in normal working status.

The following is description of the use process of the vertical self-priming pump provided in the present invention combining FIG. 6 and FIG. 7.

As shown in FIG. 6, during the startup and vacuumizing process of the self-priming pump, the elastic supporting sleeve 33 is under action of its elastic force, and the moving ring 31 is separated from the static ring 32, thus the liquid medium separated from the gas-liquid separation chamber 12 goes down and enters the cavity G enclosed by the elastic supporting sleeve 33, the impeller 22, the flow-blocking depressurization plate 50 and the upper surface of the flow guide body 40 as well as the moving ring 31 and static ring 32 through the gap between the moving ring 31 and static ring 32, and flows back to outlet of the impeller channel 23 of the impeller 22 through the backflow gap channel 24 between the outer circumferential surface of the impeller 22 and the flow-blocking depressurization plate 50, so as to carry out liquid-gas mixing with the gas that is sucked into the liquid storage chamber 13 from the liquid inlet pipe 16 and then delivered through the axial inlet hole 18 and the impeller channel 23; at last the mixture is discharged to the gas-liquid separation chamber 12 through the radial flow guide hole 41 on the flow guide body 40 to carry out gas-liquid separation; such process is repeatedly circulated to keep discharging the gas in the liquid inlet pipe 16 to finish the vacuum izing startup process. The arrow direction in FIG. 6 is the flow direction of liquid medium.

As shown in FIG. 7, when the impeller 22 continuously discharges the liquid medium in the liquid storage chamber 13 into the gas-liquid separation chamber 12, the pressure of the liquid medium in the gas-liquid separation chamber 12 increases continuously and takes effect on the upper surface of the elastic supporting sleeve 33 and makes it generate downward deformation, because the backflow gap channel 24 is very shallow (0.3-0.5 mm), the liquid medium generates big resistance loss when passing by, and the plurality of circular grooves 52 in the backflow gap channel 24 enlarges the flow space of medium suddenly to further decrease pressure in the backflow gap channel; as a result, the pressure of medium in cavity G is much lower than that in the gas-liquid separation chamber 12, which helps the elastic supporting sleeve 33 to generate downward deformation and press lower surface of the static ring 32 to be in close fit with upper surface of the moving ring 31, thus to form sealing and block backflow of the liquid medium. As a result, the volume loss generated by the circulating backflow is avoided, and the pump efficiency is improved by 5% to 8%. The arrow direction in FIG. 7 is the flow direction of liquid medium. The gap channel between the lower end surface of the flow-blocking depressurization plate 50 and step surface of the impeller 22 is provided with a downwards slant dip angle to generate bigger pressure loss and increase the pressure difference between the cavity G and the gas-liquid separation chamber 12, and the slant dip angle a, which is 3-8 degrees, is the best angle obtained by the inventor after a large number of experiments. This angle realizes that it would not make impeller generate big vibration due to impact while enlarging the pressure difference. The plurality of circular grooves 52 can also enlarge the pressure difference between the cavity G and the gas-liquid separation chamber 12.

When the vertical self-priming pump stops working, the check valve 15 is closed quickly to block backflow of the high liquid medium in the liquid outlet pipe 14; at the same time, the vacuum breaking valve 17 on the liquid inlet pipe 16 is synchronously opened so that gas enters into the liquid inlet pipe 16 to break the vacuum status thereof; therefore, the problem that all liquid medium in the pump flows back and drains because of siphonage is completely avoided. As a result, the liquid storage chamber 13 is always remaining a part of pumped liquid medium, so as to realize the self-priming forever goal of the self-priming pump after drainage for once.

The present invention is not limited by the above best implementation way. Any structural change inspired by the present invention and any technical proposal that is same as or similar with the present invention should belong to the protection scope of the present invention.

The invention claimed is:

1. A vertical self-priming pump, comprising a pump body, wherein an inner cavity of the pump body is divided into a gas-liquid separation chamber and a liquid storage chamber through a middle partition plate that is provided with an axial inlet opening, and the gas-liquid separation chamber is above the liquid storage chamber; a flow guide body is fixed on an upper surface of the middle partition plate; the flow guide body is provided with an axial through hole and a radial flow guide hole that is in communication with the axial through hole, and the gas-liquid separation chamber is in communication with the liquid storage chamber through the axial inlet opening and the radial flow guide hole on the flow guide body;

a motor, which is fixed on the top of the pump body for driving a pump shaft to rotate, and the pump shaft downwardly penetrates into the inner cavity of the pump body, and an impeller that is arranged in the axial through hole of the flow guide body is fixed on a lower end of the pump shaft; a backflow gap channel is formed between an outer circumferential surface of the impeller and an inner wall of the axial through hole of the flow guide body;

a medium backflow blocking device that comprises a static ring and a moving ring which are vertically and oppositely arranged as well as an elastic supporting sleeve; the moving ring is embedded on an upper surface of the impeller, and an outer edge of the elastic supporting sleeve extends downwards to form a supporter that is fixed on an upper surface of the flow guide body; the static ring is embedded on a lower surface of an elastic supporting ring, and a lower end surface of the static ring protrudes the lower surface of the elastic supporting sleeve, and a gap is formed between a lower end surface of the static ring and an upper end of the moving ring; and a flow-blocking depressurization plate;

wherein an upper part of the impeller is in a step axle shape with a top part smaller than a lower part, and the flow-blocking depressurization plate is in a step sleeve shape with top part bigger than the lower part and provided with an axle hole; the flow-blocking depressurization plate is vertically sleeved on the impeller with a big-diameter part fixed on the flow guide body; a backflow gap channel is formed by the gap between inner wall of the axle hole of the flow-blocking depressurization plate and outer circumferential surface of a small-diameter part of the impeller and a gap between the lower end surface of the flow-blocking depressurization plate and step surface of the impeller.

2. The vertical self-priming pump according to claim 1, wherein a size of the backflow gap channel is 0.3-0.5 mm.

3. The vertical self-priming pump according to claim 1, wherein the gap channel between the lower end surface of the flow-blocking depressurization plate and the step surface of the impeller is provided with a downwards slant dip angle.

4. The vertical self-priming pump according to claim 3, wherein the dip angle is 3-8 degrees.

5. The vertical self-priming pump according to claim 1, wherein the inner wall of the axle hole of the flow-blocking depressurization plate is provided with a plurality of circular grooves.

6. The vertical self-priming pump according to claim 1, wherein the moving ring and the static ring are made of same material, which is hard alloy, silicon carbide, ceramic, graphite or polytetrafluoroethylene.

7. The vertical self-priming pump according to claim 2, wherein the moving ring and the static ring are made of same material, which is hard alloy, silicon carbide, ceramic, graphite or polytetrafluoroethylene.

8. The vertical self-priming pump according to claim 3, wherein the moving ring and the static ring are made of same material, which is hard alloy, silicon carbide, ceramic, graphite or polytetrafluoroethylene.

9. The vertical self-priming pump according to claim 4, wherein the moving ring and the static ring are made of same material, which is hard alloy, silicon carbide, ceramic, graphite or polytetrafluoroethylene.

* * * * *